US007536939B2

(12) United States Patent
Bureau

(10) Patent No.: US 7,536,939 B2
(45) Date of Patent: May 26, 2009

(54) APPARATUS AND METHOD FOR CURVE SAWING OF A PLANK

(76) Inventor: Côme Bureau, 9896, boul. Sainte-Anne, Sainte-Anne-de-Beaupré, (Québec) (CA) G0A 3C0

( * ) Notice: Subject to any disclaimer, the term of this patent is extended or adjusted under 35 U.S.C. 154(b) by 98 days.

(21) Appl. No.: 10/539,652

(22) PCT Filed: Jun. 25, 2004

(86) PCT No.: PCT/CA2004/000952

§ 371 (c)(1),
(2), (4) Date: Jun. 14, 2005

(87) PCT Pub. No.: WO2004/113003

PCT Pub. Date: Dec. 29, 2004

(65) Prior Publication Data

US 2006/0027061 A1 Feb. 9, 2006

(30) Foreign Application Priority Data

Jun. 26, 2003 (CA) ..... 2434434

(51) Int. Cl.
*B27B 1/00* (2006.01)
*B27C 5/02* (2006.01)

(52) U.S. Cl. ..... 83/75.5; 83/76.8; 83/367; 144/357; 144/242.1; 144/248.5; 144/253.7; 144/378

(58) Field of Classification Search ..... 83/102.1, 83/75.5, 364–365, 367; 144/355–357, 242.1, 144/248.5, 250.2, 215.2, 253.7, 250.13, 250.15, 144/246.2

See application file for complete search history.

(56) References Cited

U.S. PATENT DOCUMENTS 2,169,394 A * 8/1939 Richardson ..... 144/246.1

(Continued)

FOREIGN PATENT DOCUMENTS

CA 1131551 9/1982

(Continued)

OTHER PUBLICATIONS

International Search Report for International Application No. PCT/CA2004/000952, dated Nov. 3, 2004.

*Primary Examiner*—Boyer D. Ashley
*Assistant Examiner*—Laura M. Lee
(74) *Attorney, Agent, or Firm*—Knobbe Martens Olson & Bear LLP

(57) ABSTRACT

The invention concerns an apparatus and method for guiding a plank towards cutting tools for curve sawing of the plank. The apparatus comprises a first guide and drive mechanism mounted on a platform for receiving, guiding and driving the plank along a path. The first mechanism comprises two first elements arranged opposite relative to the path. The apparatus comprises a second guide and drive mechanism mounted on the platform for guiding and driving the plank from the first mechanism along the path on the support surface up to the cutting tools. The second mechanism comprises two second elements arranged opposite relative to the path while being parallel to the path. The elements of the mechanisms located on the same side of the path are connected through a pivot pin. The apparatus further comprises displacing means for parallel and equidistant displacement relative to the path of the elements of the mechanisms.

14 Claims, 16 Drawing Sheets

U.S. PATENT DOCUMENTS

| | | | | | |
|---|---|---|---|---|---|
| 2,794,466 | A | * | 6/1957 | Leffler | 144/247 |
| 3,045,728 | A | * | 7/1962 | Hutchinson et al. | 144/208.8 |
| 3,392,764 | A | * | 7/1968 | Yeadon | 144/208.1 |
| 3,510,042 | A | * | 5/1970 | Romere | 226/177 |
| 3,844,398 | A | | 10/1974 | Pinat | |
| 3,844,399 | A | * | 10/1974 | Sellers et al. | 198/624 |
| 4,144,782 | A | * | 3/1979 | Lindstrom | 83/102.1 |
| 4,210,184 | A | * | 7/1980 | McGriff | 144/364 |
| 4,637,443 | A | * | 1/1987 | Jansson | 144/39 |
| 4,724,877 | A | * | 2/1988 | Culley, Jr. | 144/116 |
| 4,881,584 | A | * | 11/1989 | Wislocker et al. | 144/39 |
| 4,947,909 | A | * | 8/1990 | Stroud | 144/357 |
| 5,421,386 | A | * | 6/1995 | Lundstrom | 144/357 |
| 5,435,361 | A | * | 7/1995 | Knerr | 144/378 |
| 5,447,186 | A | * | 9/1995 | Achard et al. | 144/357 |
| 5,853,038 | A | * | 12/1998 | Newnes | 144/357 |
| 6,039,098 | A | * | 3/2000 | Kennedy et al. | 144/357 |
| 6,216,756 | B1 | * | 4/2001 | Mason | 144/248.5 |
| 6,860,302 | B2 | * | 3/2005 | Brisson | 144/382 |
| 6,896,019 | B2 | * | 5/2005 | Achard et al. | 144/357 |
| 7,117,907 | B2 | * | 10/2006 | Mitchell | 144/39 |
| 2002/0074062 | A1 | | 6/2002 | McGehee et al. | |

FOREIGN PATENT DOCUMENTS

| | | |
|---|---|---|
| CA | 2022857 | 2/1992 |
| EP | 0 499 797 A1 | 8/1992 |

* cited by examiner 114
34
110
40

112
38

APPARATUS AND METHOD FOR CURVE SAWING OF A PLANK

RELATED APPLICATIONS

This application is a U.S. National Phase under 35 U.S.C. 371 of the International Patent Application No. PCT/CA2004/000952, filed Jun. 25, 2004, and published in French on Dec.29, 2004 as WO 2004/113003, which claims the benefit of Canadian Patent Application No. 2,434,434, filed Jun. 26, 2003.

FIELD OF THE INVENTION

The present invention concerns the timber industry, and more particularly an apparatus and a method for curve sawing of a plank following the natural curvature of the plank.

BACKGROUND

In the timber industry, the sawing systems known in the art generally use guiding elements for guiding the planks towards cutting tools, where they are sawn into smaller planks or boards. When the plank comes to the entrance of a guiding mechanism, barbed rolls open and close on the plank, thus destabilizing the plank.

Barbed or spiked rolls provide a reduced surface of contact with the plank. Thus, when the rolls encounter knots and other surface faults on the surface of the plank, certain problems may arise:

- instability of the planks in the cutting tools caused by the surface faults and knots, whenever the rolls are in contact with these surface imperfections;
- vibration of the plank;
- poor control of the position of the rolls in the system because the pressure exerted on each roll can vary, thus not allowing precise control of the position of the rolls; and
- poor support of the plank in the system because the positioning of the plank changes in accordance with the quality of its surface and the cutting depth of the trimmer heads.

Furthermore, given the fact that the plank profile can vary from one plank to another, the systems known in the prior art are often plagued with the following problems:

- difficulty in controlling the curve sawing limits following the natural curvature of the plank;
- production of sawn timber with over pronounced curvatures, thus resulting in production rejections; and
- no possibility to reduce the tapering effect on the plank according to the cutting pattern and the cutting yield.

SUMMARY OF THE INVENTION

One of the objectives of the present invention is to overcome at least one of the problems mentioned above.

The present invention concerns an apparatus for guiding a plank towards cutting tools. The apparatus comprises evaluation means for evaluating the plank and generating a signal representing at least one parameter of the plank, a frame, and a platform mounted on the frame and having a support surface for supporting the plank. The apparatus further comprises a first guide and drive mechanism mounted on the platform for receiving, guiding and driving the plank along a path on the surface of the support. The first mechanism comprises two first guides and drive elements arranged opposite relative to the path. The apparatus also comprises a second guide and drive mechanism mounted on the platform for guiding and driving the plank from the first mechanism along the path on the support surface up to the cutting tools. The second mechanism comprises two second guide and drive elements arranged opposite relative to the path and being substantially parallel to the path. The guide and drive elements of the mechanisms situated on a same side of the path are connected through a pivoting axis. The apparatus further comprises displacing means for displacing the guide and drive elements from the first and second mechanisms in parallel and equidistant relative to the path in response to the signal.

Preferably, the platform comprises two support plates equidistant relative to the path. The guide and drive elements of the mechanisms located on the same side of the path are mounted on the corresponding support plate. The apparatus also comprises two actuators for displacing the support plates transversally with respect to the path and in response to the control signal. Each of the actuators is mounted transversally with respect to the path and comprises a first end fixed to the frame and a second end fixed to the corresponding support plate.

Preferably, each of the guide and drive elements of the mechanisms comprises an endless belt having an exterior surface covered with a toothed chain mat, and toothed wheels for driving the belt.

Preferably, the guide and drive elements of the mechanisms located on the same side of the path have a common toothed wheel which is fit for turning about the pivot axis, the belts of the guide and drive elements of the mechanisms located on the same side of the path together forming a single belt.

Preferably, each of the drive and guide elements of the mechanisms comprises a support wall facing the path and located between the toothed wheels for supporting the belt.

Preferably, the displacing means comprise first and second pairs of jointed arms located on either side of the path. The arms of each pair are located in parallel and the arms of each pair are mounted between the support surface and the corresponding second guide and drive element. The displacing means also comprise a mechanical connection linking the first and second pairs of jointed arms for coordinating a movement of the pairs of jointed arms in parallel and equidistant relative to the path.

Preferably, the mechanical connection comprises a means for adjusting the length of the mechanical connection in accordance with the distance between the support plates.

Preferably, the means for adjusting the length of the mechanical connection comprise an actuator mounted on the mechanical connection between the first and second pairs of jointed arms.

Preferably, the first and second guide and drive mechanisms comprise means for exerting a pressure on the first and second guide and drive elements on each side of the plank.

Preferably, the means for exerting a pressure on the first guide and drive elements comprise two actuators being mounted between the first element and the second element on the same side of the path.

Preferably, the means for exerting a pressure on the second guide and drive elements comprise two actuators being mounted between the support surface and the corresponding second element.

Preferably, the means for exerting a pressure on the first guide and drive elements comprise two bellows being mounted between the first element and the second element on the same side of the path.

Preferably, the means for exerting a pressure on the second guide and drive elements comprise two bellows being mounted between the support surface and the corresponding second element.

Preferably, the apparatus further comprises two trimming heads mounted on each side of the path.

Preferably, the apparatus further comprises detection means for detecting different positions of the plank in the apparatus, and activation means for activating the first and second guide and drive mechanisms as a function of different positions of the plank.

Preferably, the detection means comprise photocells for detecting a displacement of the plank when the plank is received by the first guide and drive mechanism.

The present invention also concerns a method for guiding a plank towards cutting tools, comprising the following steps:

a) evaluating the plank and generating a signal representing at least one parameter of the plank;

b) receiving, guiding and driving the plank along the path by a first guide and drive mechanism, the first mechanism comprising two first guide and drive elements located opposite relative to the path;

c) guiding and driving the plank by a second guide and drive mechanism from the first mechanism along the path up to the cutting tools, the second mechanism comprising two second guide and drive elements located opposite relative to the path and being substantially parallel to the path, the guide and drive elements of the mechanisms located on the same side of the path being connected by a pivoting axis; and d) displacing the guide and drive elements of the first and second mechanisms in a way that is parallel and equidistant in relation to the path and that is in response to the signal.

The invention and its advantages will be better understood upon reading the following description, which relates to preferred embodiments of the invention, gives a non-limiting example and explains it with reference to the attached drawings.

DETAILED DESCRIPTION OF A PREFERRED EMBODIMENT OF THE INVENTION

Figure 1:
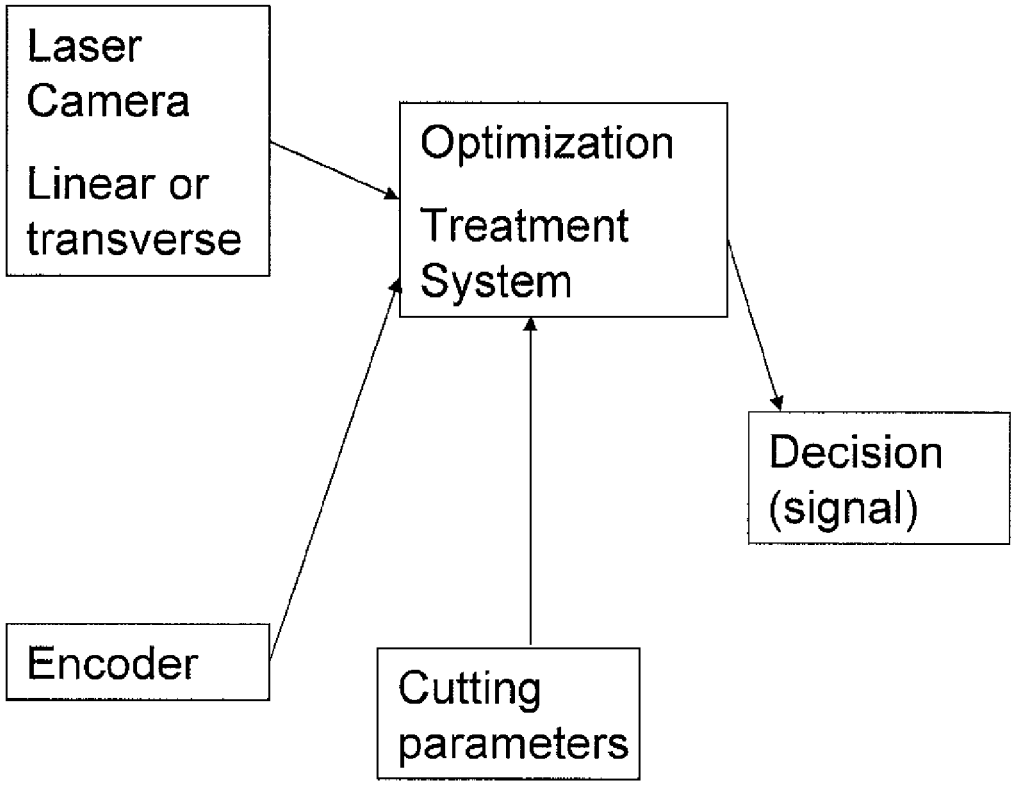
FIG. 1 is a block diagram showing evaluation means for evaluating a plank and generating a cutting pattern.
Figure 2:
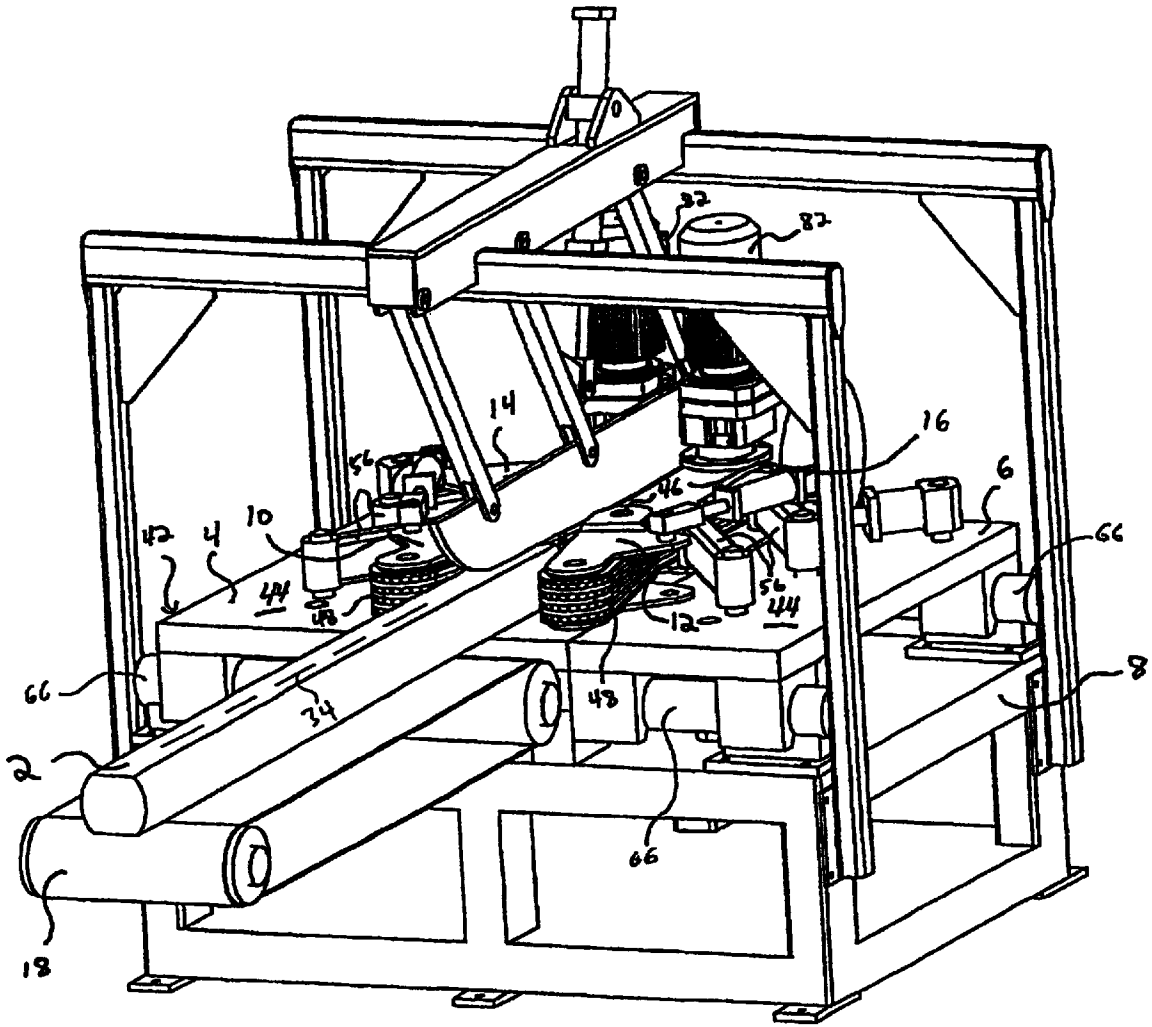
FIG. 2 is a perspective view of a curve sawing apparatus according to a preferred embodiment of the present invention.
Figure 3:
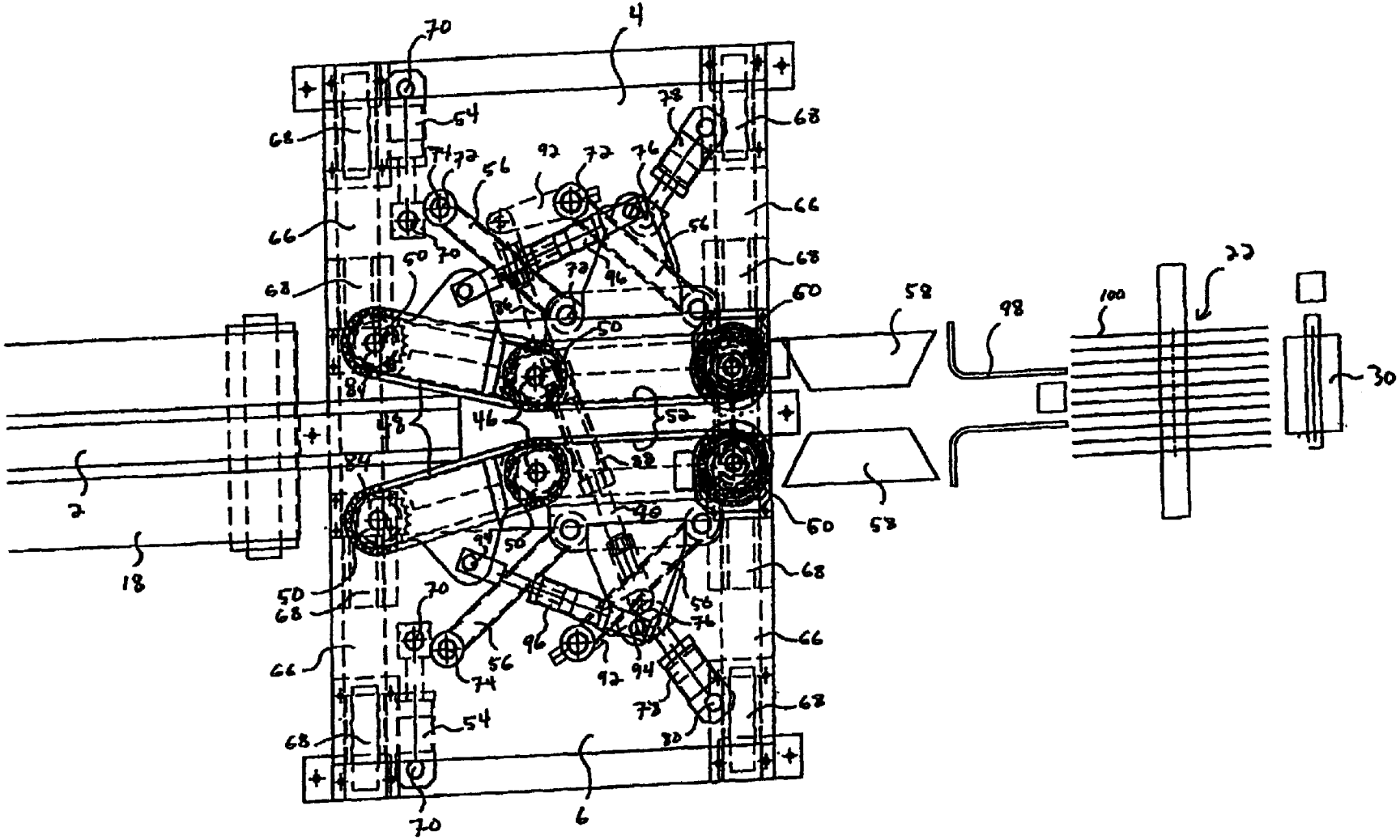
FIG. 3 is a detailed above view schematic of a curve sawing apparatus according to the present invention.
Figure 4:
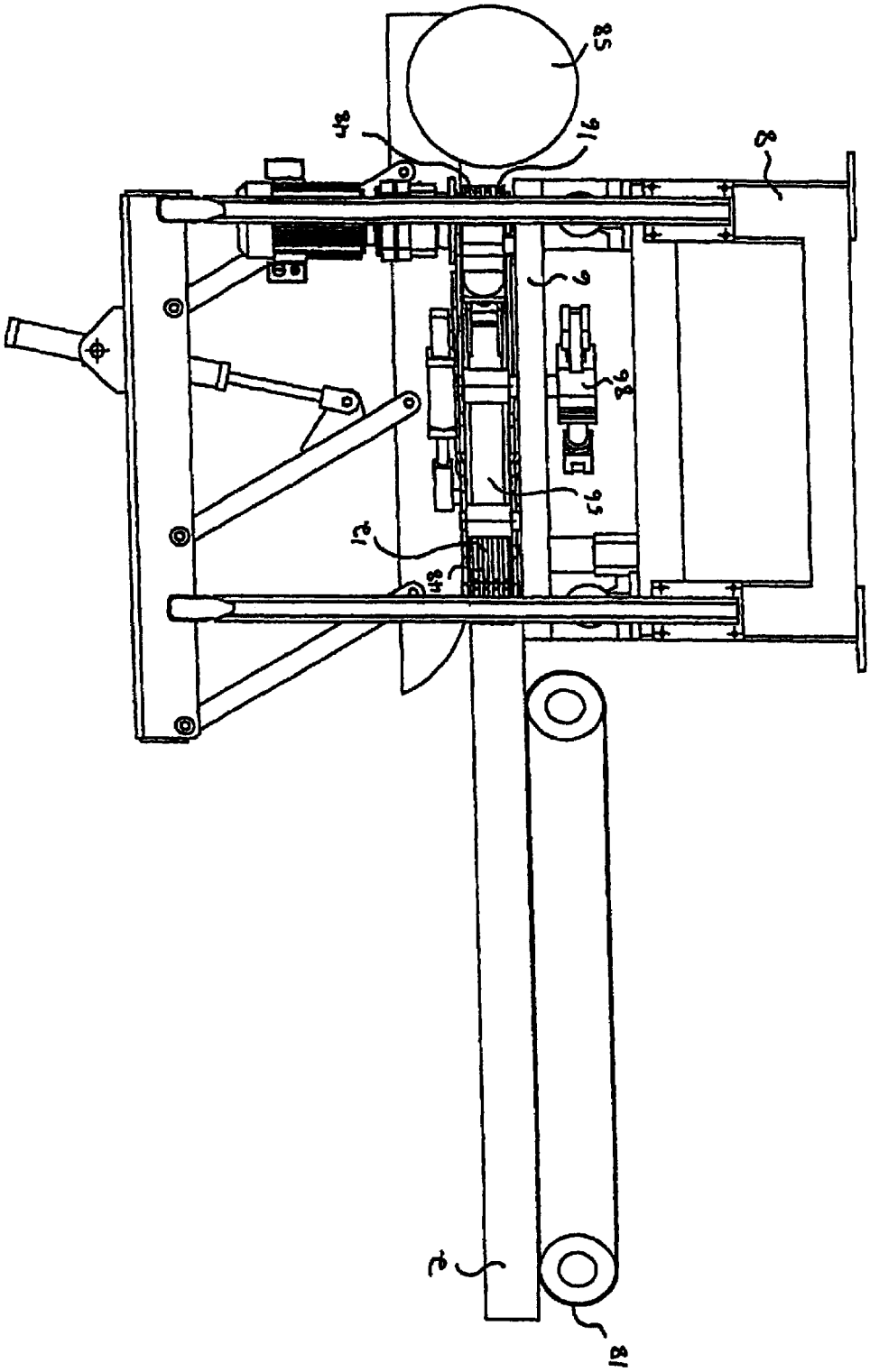
FIG. 4 is a side view schematic of a curve sawing apparatus according to the present invention.

Referring to FIGS. 1 to 4, a curve sawing apparatus according to a preferred embodiment of the present invention is shown. This apparatus guides a plank (2) towards cutting tools (22), where the plank (2) is sawn into boards in accordance with a predetermined cutting pattern.

In order to determine the cutting pattern to be used for a given plank (2), the apparatus has an evaluation means for evaluating the plank (2) and generating a signal representing at least one parameter of the plank (2) such as its taper, thickness, length and curvature.

The apparatus has a frame (8) and a platform (42) mounted on the frame (8). The platform 42 has a support surface (44) for supporting the plank (2).

The apparatus also has a first guide and drive mechanism mounted on the platform (42) for receiving, guiding and driving the plank (2) along a path (20) on the support surface (44). The first mechanism comprises two first guide and drive elements (10, 12) located opposite relative to the path (20).

The apparatus also has a second guide and drive mechanism mounted on the platform (42) for guiding and driving the plank (2) from the first mechanism along the path (20) on the support surface (44) up to the cutting tools (22). The second mechanism has two second guide and drive elements (14,16) located opposite relative to the path (20) and being substantially parallel to the path (20).

The guide and drive elements of the mechanisms located on the same side of the path (20), such as the elements (10) and (14) as well as the elements (12) and (16), are connected by a pivoting axis (46).

The apparatus also comprises displacing means for displacing the guide and drive elements of the first and second mechanisms in a way that is parallel and equidistant in relation to the path (20) and that is in response to the signal.

Preferably, the displacing means comprise first and second pairs of jointed arms (56) located on either side of the path (20). The arms (56) of each pair are oriented in parallel and are mounted between the support surface and the corresponding second guide and drive elements (14,16). A mechanical connection (86) links the first and second pairs of jointed arms (56) for coordinating a movement of the pairs of jointed arms (56) in a way that is parallel and equidistant in relation to the path (20).

Preferably, the means for adjusting the length of the mechanical connection (86) comprise a hydraulic actuator (88) or Temposonic mounted to the mechanical connection (86) itself between the first and second pairs of jointed arms (56).

Preferably, each pair of jointed arms (56) forms a parallelogram linked by the automatic centering mechanical connection (86) which ensures that the positioning of the plank is parallel and centered in relation to the central axis (64) of the apparatus and always centered in relation to pivot points (72). The plank is well held, no matter the cutting depths produced on the side of the plank by the trimming heads (58) or the defects on the surface of the plank. The parallelogram positioning system and the pressure exerted on the sides of the plank by the surfaces of the guide mechanism allow for the position and stability of the plank in the cutting tools (22) to be controlled.

Preferably, the platform (42) comprises a positioning module for the guide and drive mechanisms having two support plates (4, 6) equidistant in relation to the path (20). The guide and drive elements of the mechanisms located on the same side of the path (20) are mounted on the corresponding support plate (4, 6). The apparatus also comprises two actuators (54) for displacing the support plates (4, 6) in response to the control signal transversally in relation to the path (20). Each actuator (54) is transversally mounted with respect to the path 20 and comprises a first end fixed to the frame (8) and a second end fixed to the corresponding support plate (4, 6).

The whole of the guide mechanisms sits on the support plates (4, 6). These plates may be mobile steel plates on which all the components of the guide mechanisms of the plank are mounted. The displacement of these plates (4, 6) permits:

positioning the guide elements (14,16) for curve sawing in accordance with the width of the plank to be guided;

reducing the course of the arms (56) which form the parallelogram positioning system and automatic centering element of the second guide mechanism for curve cutting in order to reduce the distance between the toothed wheels (50) of the corresponding plates (4, 6) and the trimming heads (58) to a minimum;

positioning the central axis (34) of the plank (2) in relation to a central axis (64) of the apparatus and in relation to the cutting tools (22);

positioning the plank in a manner so that it is centered or not in relation to the central axis (64) of the apparatus, and in such a way that is centered or not in relation to the cutting tools (22);

positioning the guide mechanisms in accordance with the tapering of the plank and the chosen wood cutting pattern;

displacing the central axis (34) of the plank's fine end (112) either to the right or to the left of the central axis (64) of the apparatus or the trimming heads (56). As the plank (2) is squared off or cut, it is displaced so that it is gradually taken along so that the central axis (34) of the plank at the coarse end (114) corresponds to the central axis (64) of the apparatus or of the trimming heads (58), in order to maximize the quality and yield of cutting the plank (see FIGS. 15*a*, b, c);

positioning the cutting pattern so that it is centered or not in relation to the central axis (64) of the apparatus, and so that it is centered or not in relation to the cutting tools (22); and positioning the cutting pattern in accordance with the tapering of the plank and the chosen cutting pattern.

When the plates (4, 6) are displaced, the mechanical connection (86) assures the centering of the guide mechanism (14,16) of the curve cutting.

Preferably, each of the guide and drive elements of the mechanisms comprises an endless belt (48) having an exterior surface covered with a spiked chain mat, and toothed wheels (50) to drive the belt (48).

Preferably, the guide and drive elements of the mechanisms located on the same side of the path have a common toothed wheel (50) which is able to turn about the pivot axis (46). The belts (48) of the guide and drive elements of the mechanism located on the same side of the path (20) together form a single belt (48).

Preferably, each of the guide and drive elements of the mechanisms comprises a support wall (52) facing the path (20) and located between the toothed wheels (50) for supporting the belt (48).

Preferably, the pressure of the belts (48) on the plank (2) is assured by a pneumatic system.

Preferably, the first and second drive and guide mechanisms comprise means for exerting a pressure on the first and second guide and drive elements on each side of the plank.

Preferably, the means for exerting a pressure on the first guide and drive elements comprise two actuators (96) being mounted between the first element (10 or 12) and the second element (14 or 16) of a same side of the path.

Preferably, the means for exerting a pressure on the second guide and drive elements comprise two actuators (78) being mounted between the support surface and the corresponding second element (14 or 16).

Preferably, the apparatus further comprises two trimming heads (58) mounted on either side of the pat (20) to square off or trim the plank (2) before it reaches the cutting tools (22).

The first guide mechanism (10, 12) assures the reception, guiding and driving of the plank (2) across a first zone where the plank (2) is guided to the entrance of the second guide mechanism. It is in this first zone that the first guide mechanism limits the curvature of the timber products to be sawn.

The guide elements (10, 12), the pivot axis (46) and a pneumatic mechanism position the plank (2) at the entrance of the second guide mechanism following the form and dimensions of the plank.

The second guide mechanism (14, 16) assures the centering and the cutting following the curve of the plank (2) in the cutting tools (22) across a second zone, thanks to the previously mentioned displacing means.

The position of the guide elements can vary for each plank and in accordance with the displacement of the plank. The position of the guide elements is controlled with the help of data produced by software for optimizing the patterns for cutting the plank. Cylinders controlled by an automaton can change the position of the guide elements by displacing the mobile support plates (4, 6). The central axis (34) of the plank following the natural curvature of the plank finds itself displaced in relation to the central axis (64) of the apparatus when the support plates (4, 6) are displaced.

The pressure exerted on the plank (2) inside the two zones by the guide mechanisms is independent. The plank is always held between the belts (48). The second guide mechanism is automatically positioned and the plank (2) remains stable. The length of the plank (2) has no influence on the stability of the positioning. For example, it is possible to transform planks of four feet and longer and it is possible to use a single chain traction system. The position of the curvature of the plank (2) is not important.

Figure 5:
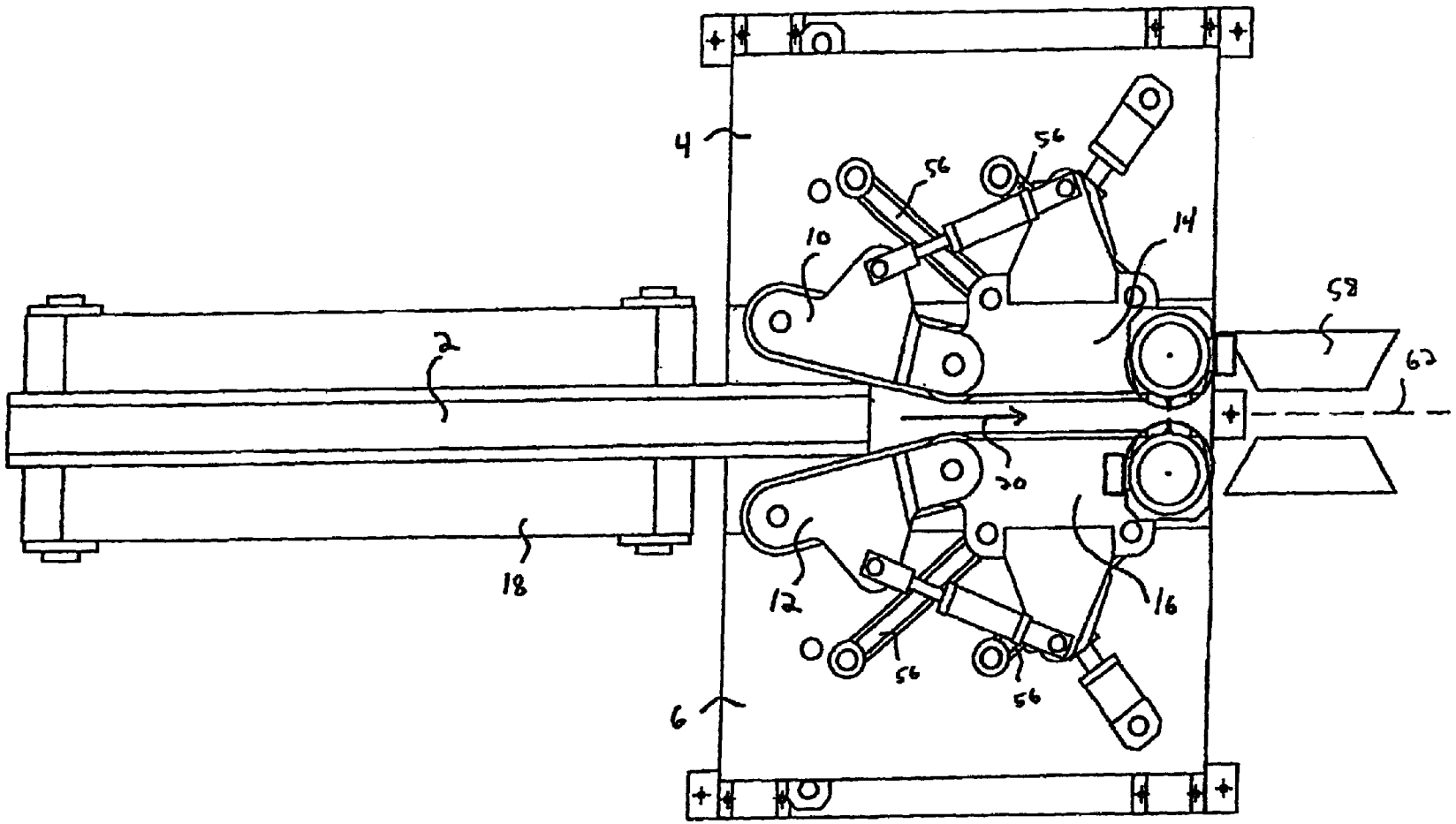
FIG. 5 is an above view schematic of a curve sawing apparatus according to the present invention, showing a plank at the entrance of the system.
Figure 6:
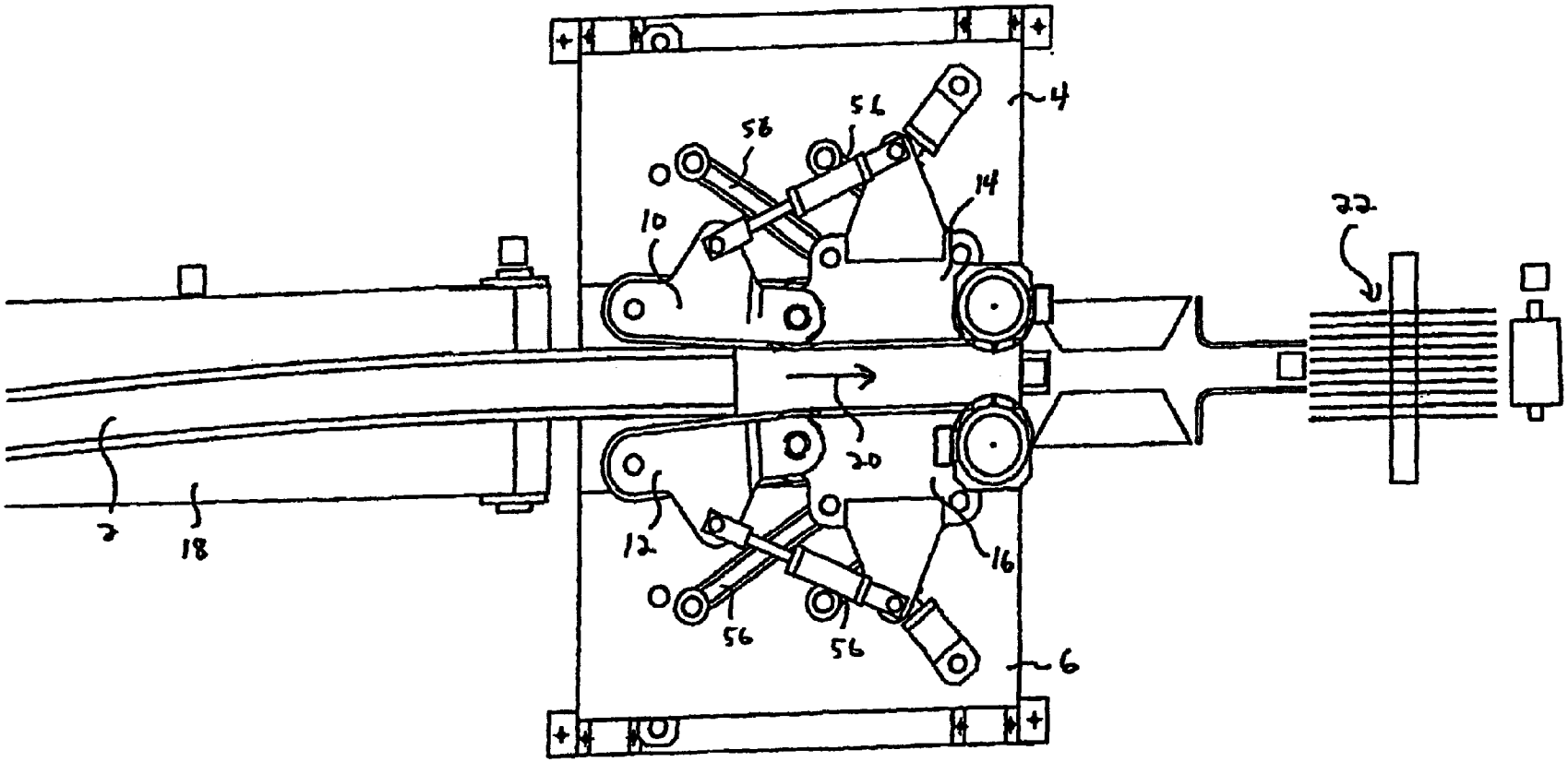
FIG. 6 is an above view schematic of a curve sawing apparatus according to the present invention, showing a first guide and drive mechanism clamping a plank with a considerable curvature.

As shown on FIG. 5, the first guide mechanism (10,12) is opened at its entry and the second guide mechanism (14, 16) for the curve cutting is in a closed position. The first mechanism (10, 12) opens to let the plank enter and, after a certain delay, the actuators (96) exert a pressure on the first guide mechanism (10, 12) in order to close it on the plank and radially open the second guide mechanism (14, 16) (see FIG. 6) for the curve cutting and drive the plank into the second guide mechanism (14, 16). At that time, the pressure of the second guide mechanism (14, 16) is released.

Figure 7:
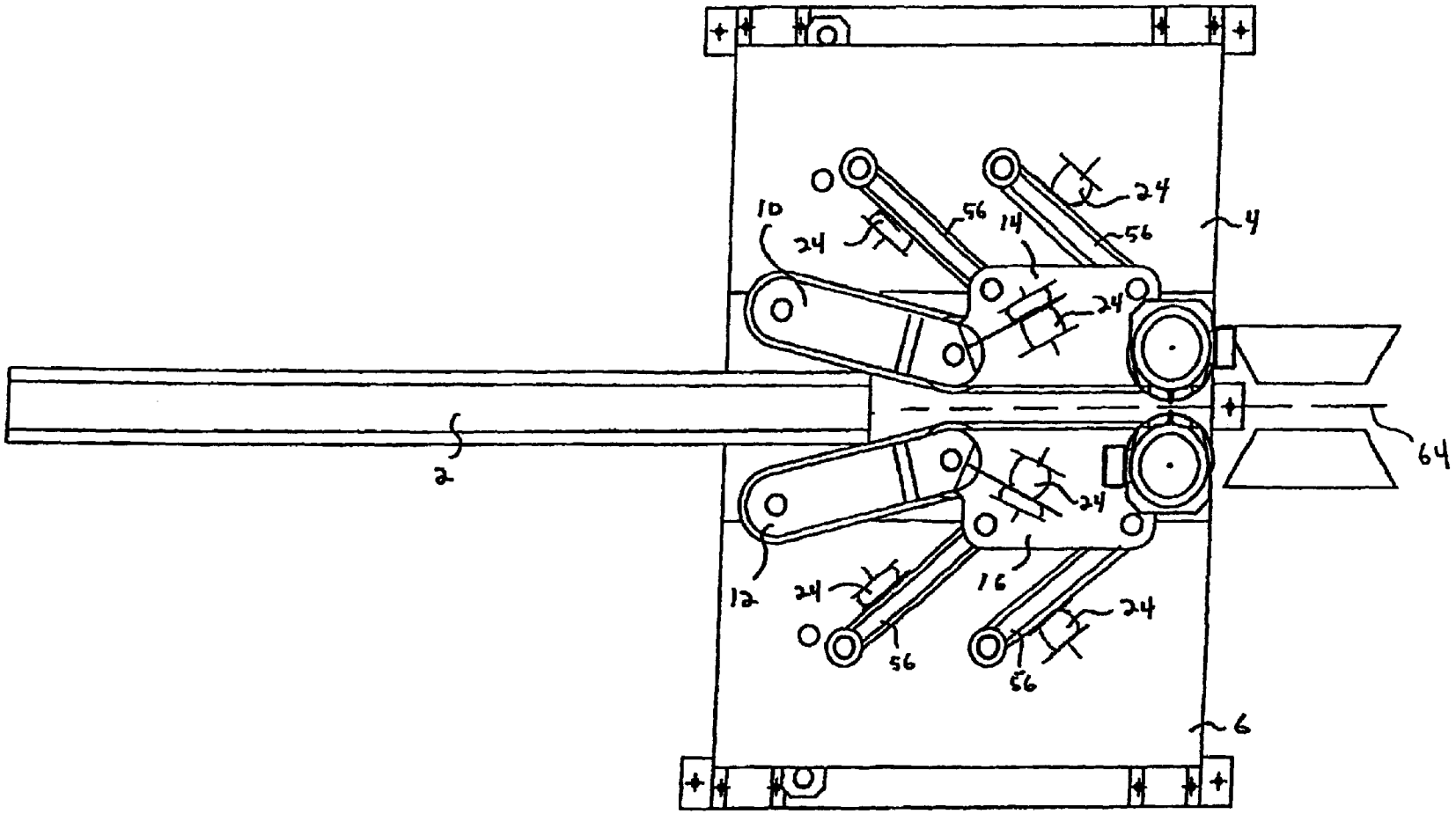
FIG. 7 is an above view schematic of a curve sawing apparatus according to the present invention, showing the use of bellows for exerting a pressure on the guide and drive mechanisms.

FIG. 7 shows the use of the bellows (24) for exerting a pressure on guide and drive mechanisms instead of using actuators (78, 96).

Figure 8:
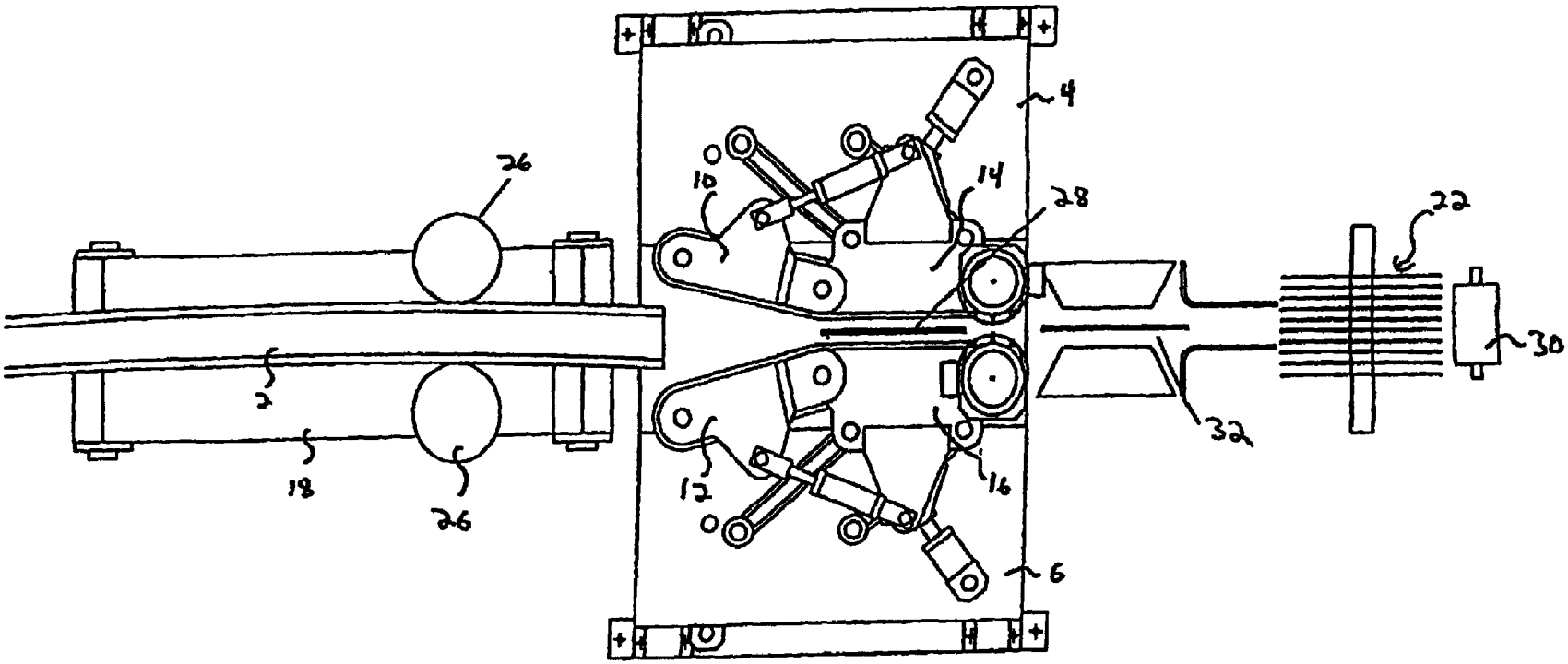
FIG. 8 is an above view schematic of a curve sawing apparatus according to the present invention, showing a stabilizing sill for supporting the plank.

FIG. 8 shows a stabilizing sill (32) for supporting the plank.

Figure 9:
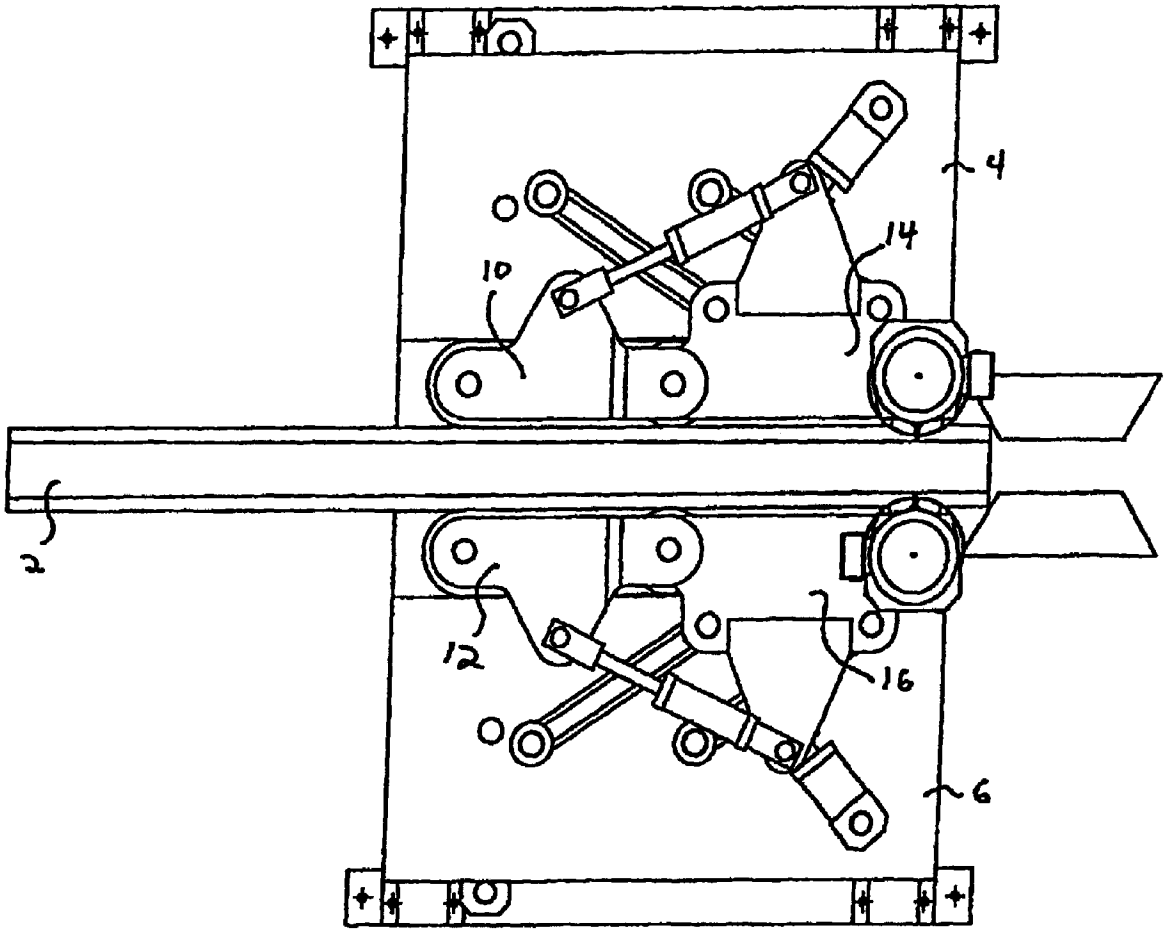
FIG. 9 is an above view schematic of a curve sawing apparatus according to the present invention, showing a plank in the guide mechanisms.

FIG. 9 shows the plank (2) inside the guide mechanisms.

Figure 10:
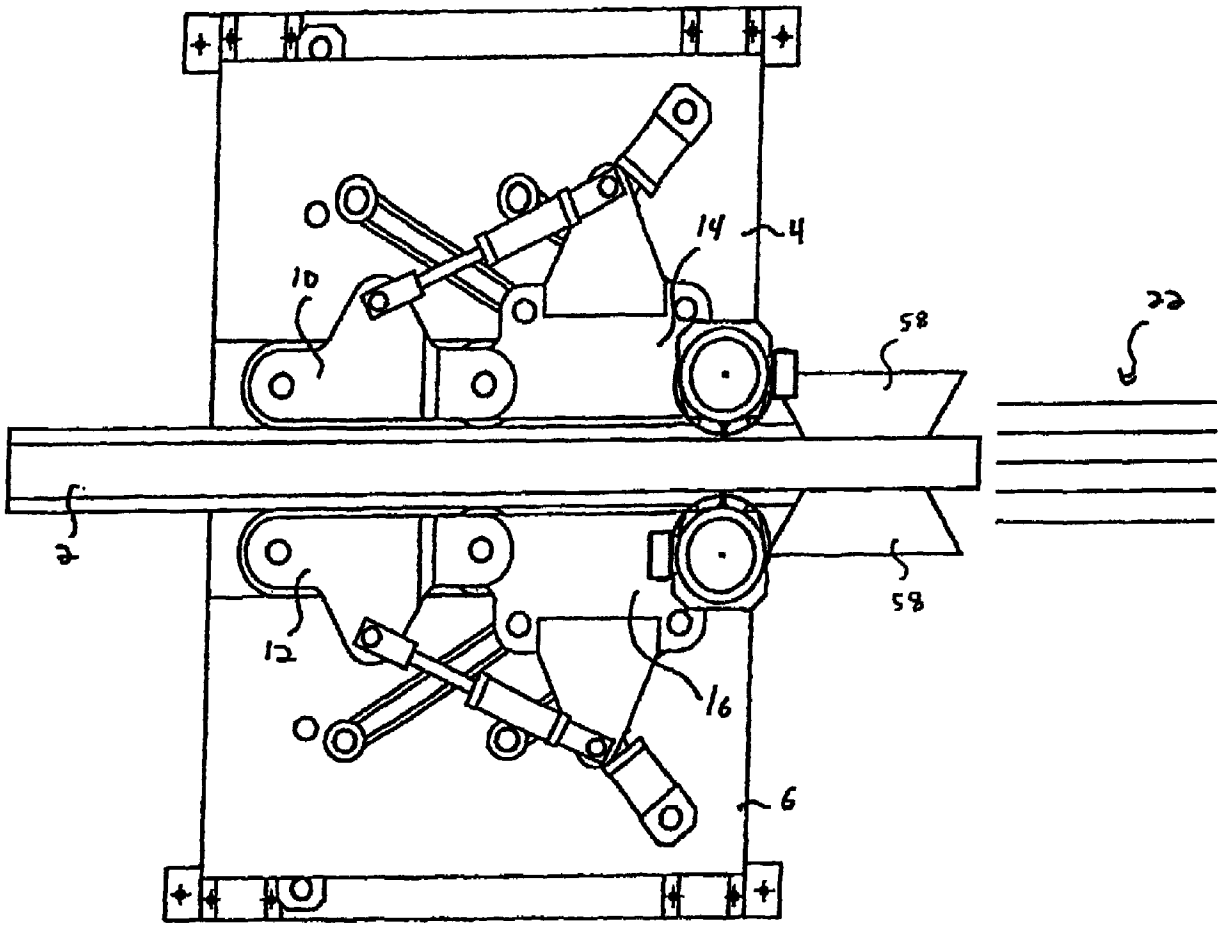
FIG. 10 is an above view schematic of a curve sawing apparatus according to the present invention, showing a part of the plank between the trimming heads.

FIG. 10 shows part of the plank (2) between the trimming heads (58).

Figure 11:
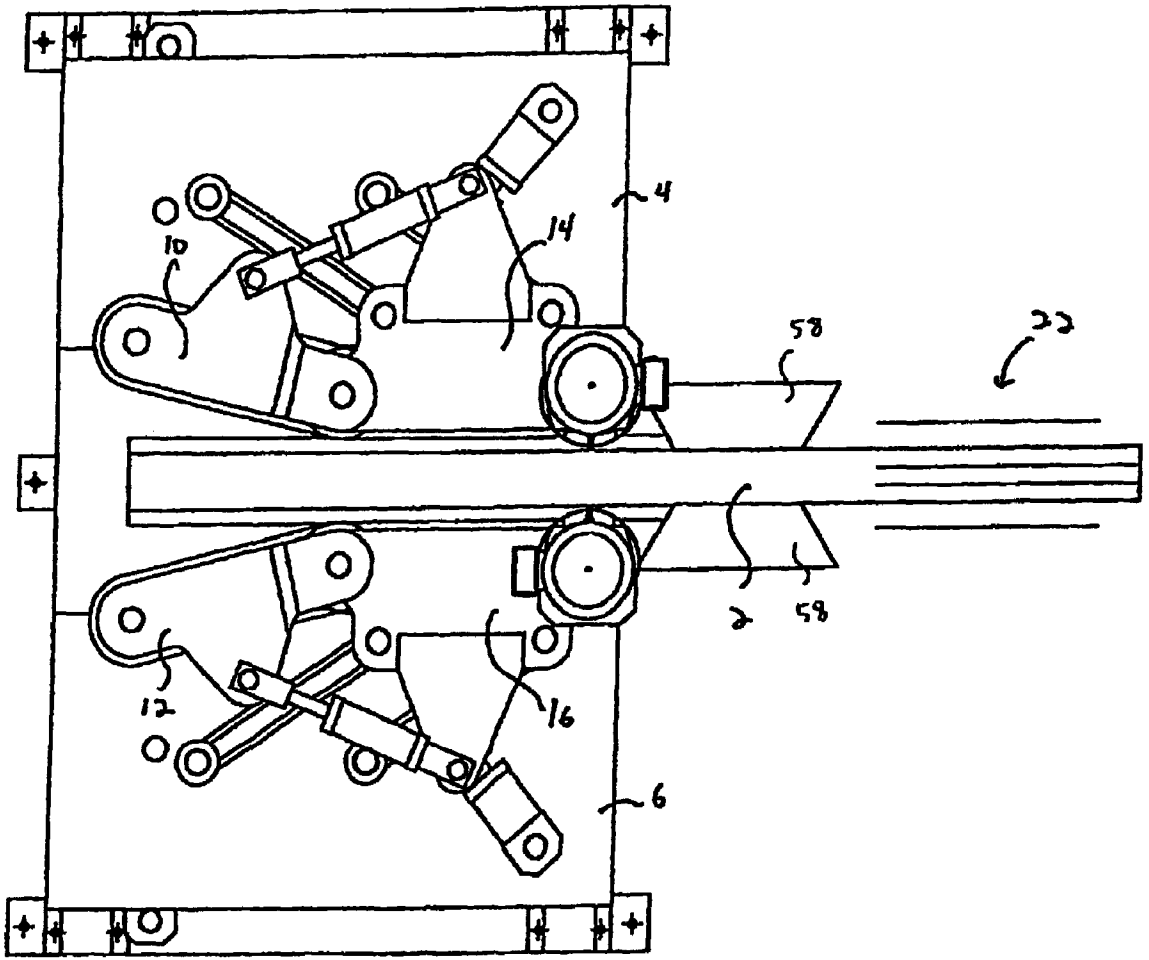
FIG. 11 is an above view schematic of a curve sawing apparatus according to the present invention, showing a part of the plank in the cutting tools.

FIG. 11 shows a part of the plank (2) in the cutting tools (22).

Figure 12:
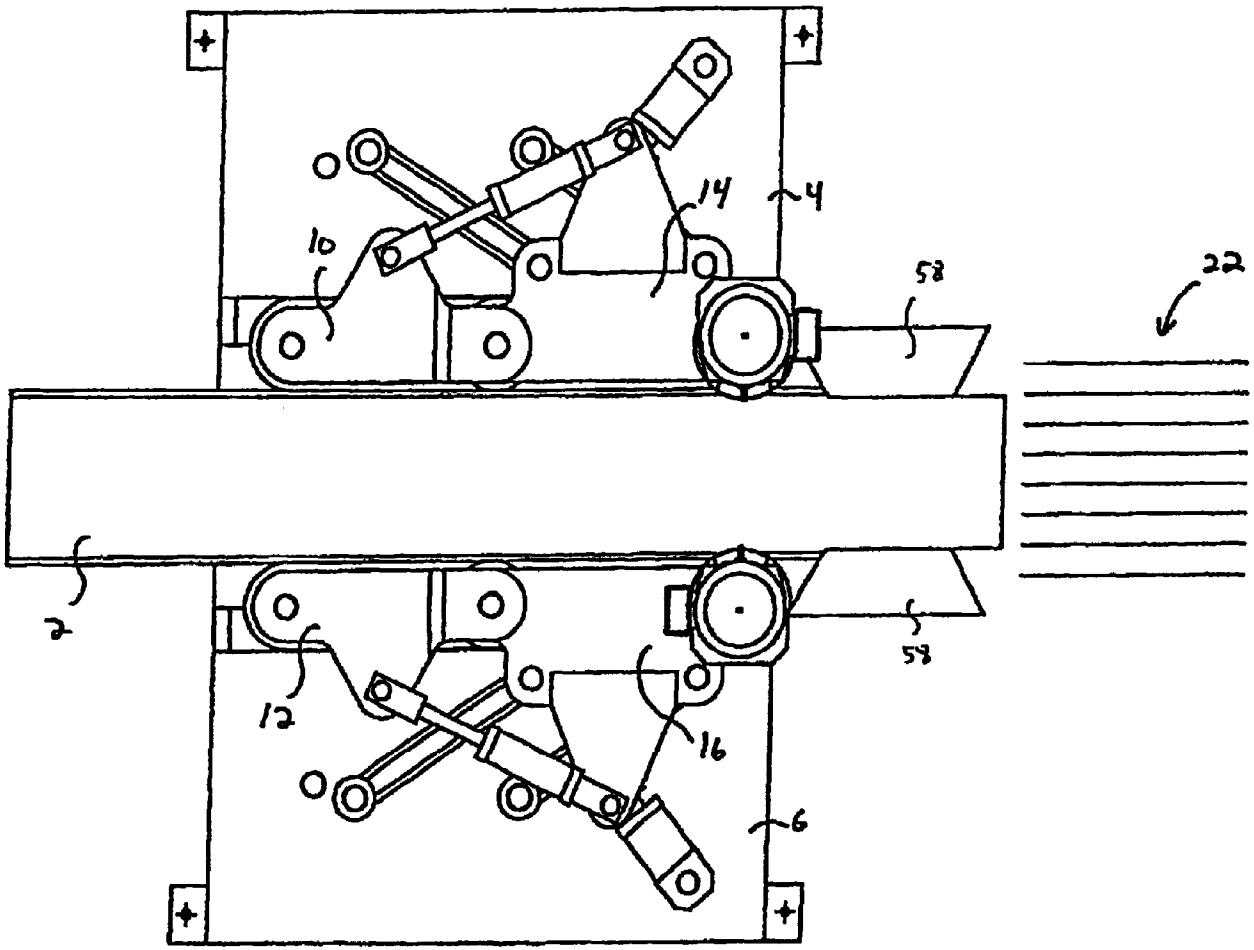
FIG. 12 is an above view schematic of a curve sawing apparatus according to the present invention, showing a large plank passing through the trimmer heads.

FIG. 12 shows a large plank (2) passing through the trimming heads (58). The plates (4, 6) are displaced so that the guide mechanisms can receive the large plank.

Figure 13:
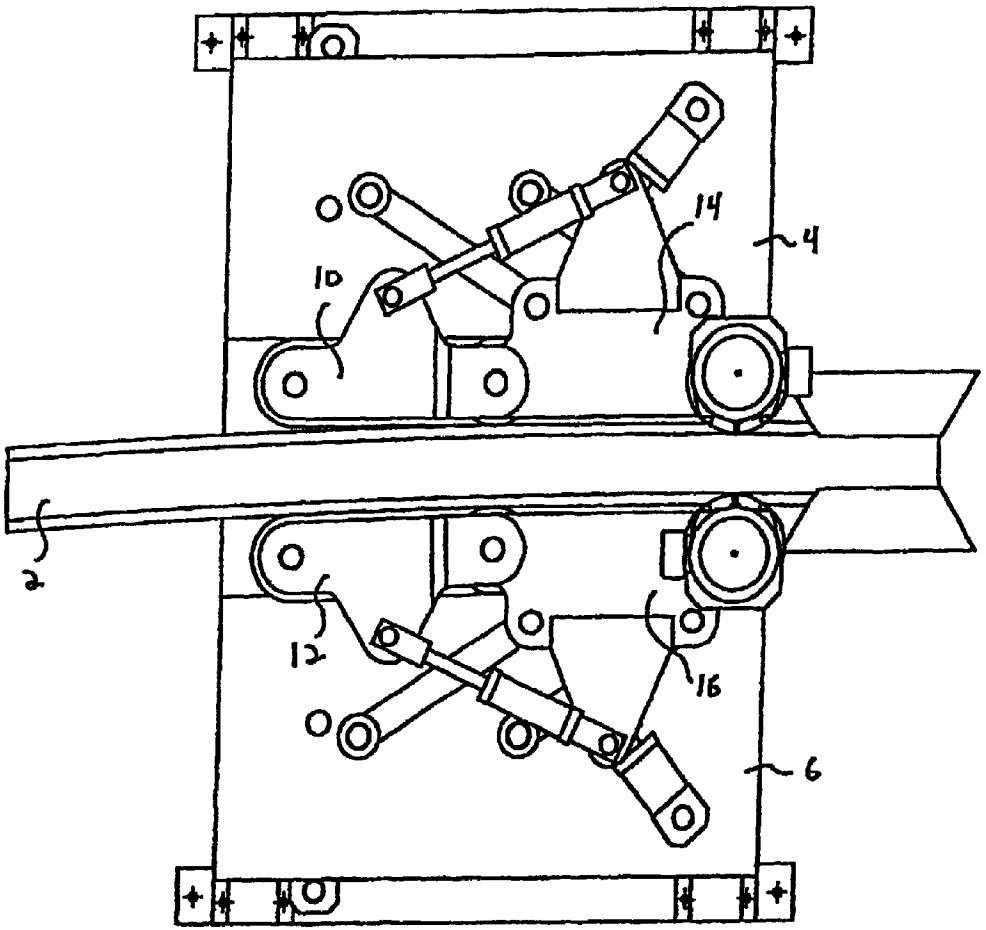
FIG. 13 is an above view schematic of a curve sawing apparatus according to the present invention, showing a plank having a significant curvature passing through the guide and drive mechanisms.

As shown in FIG. 13, the guide mechanisms are closed down on the plank. The pressure of the first guide mechanism (10,12) is reduced so that the second guide mechanism (14, 16) for the curve cutting guides the plank in accordance with its natural curvature. The volume of air of the actuators (96) of the first guide mechanism (10,12) is fixed. From this moment, the guide elements (10,12) have for function to limit the curvature of the sawn plank products whose curvatures are too extreme. The curve sawing limit for the planks having a curvature that is too pronounced is carried out in the following way: when a plank has a curvature that is too pronounced, as long as the plank advances into the first guide mechanism (10, 12), the concave side of the plank exerts a pressure on the element (12) of the first guide mechanism located on the concave side of the plank.

For example, assuming that the volume of air inside each actuator (96) of the first mechanism (10, 12) does not vary and that the concave side of the curvature of the plank tries to make the first guide mechanism (10, 12) open more on the concave side than the convex side, the pressure increases on the concave side. The first mechanism (10,12) no longer exerts the same pressure on each side of the plank. The pressure differential makes the second guide mechanism (14,16) open. The plank is no longer guided by the elements of the second mechanism (14, 16) but by the element (12) located on the concave side of the plank and by the element (14) located on the convex side of the plank (2).

The central axis (34) of the plank is no longer positioned in a parallel manner to the guide elements (14,16). The central axis (64) of the cutting apparatus diverges from the central axis (34) of the plank. While the guide element (12) is in contact with the side of the plank, the element (10) does not exert pressure on the side. The element (12) creates a pressure on the side of the plank. This pressure changes the position of the second guide mechanism (14, 16) which opens slightly. The plank is displaced towards the convex side of the plank (element 14) and becomes guided by the guide elements (12 and 14) instead of the other two elements (14,16). The position of the plank is changed. The cutting pattern no longer follows the central axis of the plank. Also, the surface of contact with the plank is increased in order to eliminate the vibrations otherwise produced by the imperfections and knots found on the sides of the plank so that the plank is stabilized in the cutting tools (22). The guide mechanisms extend the traction surface along the plank without harming the curve cutting.

The pressure is then released from the first guide mechanism (10, 12) at the entrance in order to receive the next plank.

The length of the contact surface of the second guide mechanism (14, 16) that is in contact with the plank enables controlling the radius of curvature of the sawn timber produced by the curve cutting as a function of the natural curve of the plank, eliminating the negative effects of plank surface imperfections when positioning and stabilizing the plank in the cutting tools.

The guide mechanisms maintain the wood trimming as close as possible to the trimming heads (58) in order to maximize the positioning of the plank, to stabilize the plank in the cutting tools and to eliminate the lateral displacement of the plank when the plank enters the trimming heads (58).

Figure 14A:
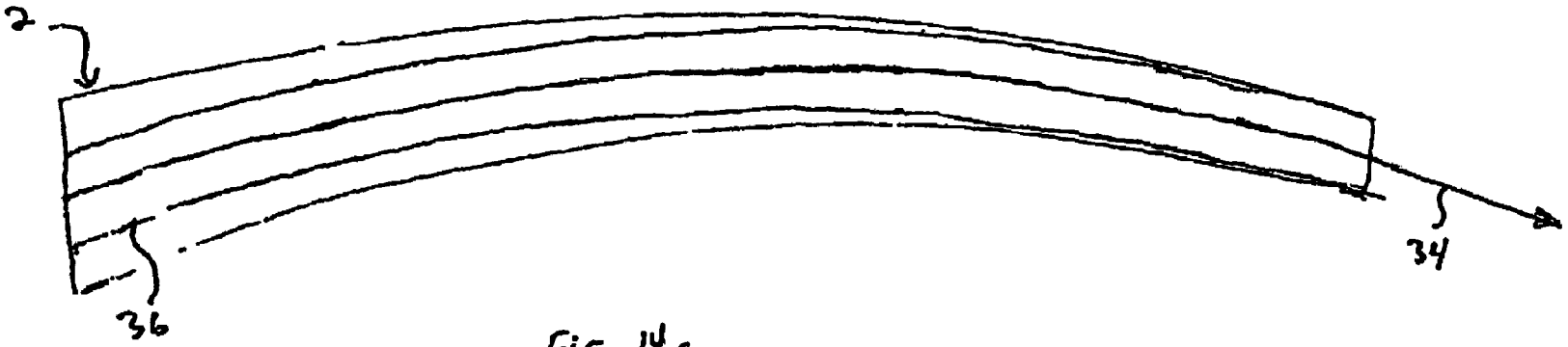
FIGS. 14*a* and 14*b* are above view schematics of a plank showing the straightening effect realized during the cutting by the guides, which limit the curve cutting of the plank having a curvature that is too pronounced.
Figure 14B:
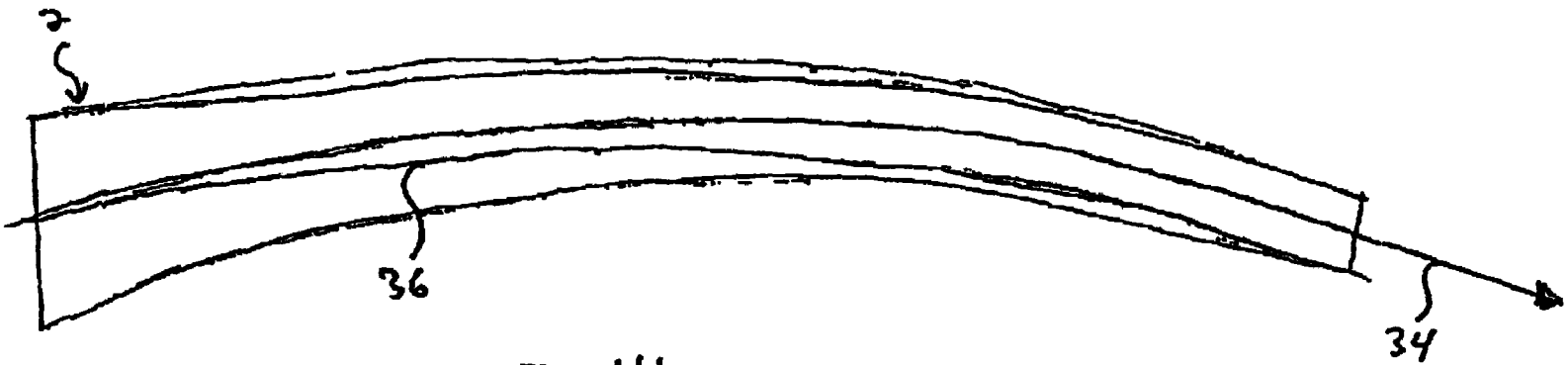

FIGS. 14*a* and 14*b* show the straightening achieved by the cutting by the guide elements limiting the curve cutting of a plank having an overly pronounced curvature (FIG. 14*b*). FIG. 14*a* shows the central axis (34) of the plank. In order to facilitate the comprehension of one of the preferred embodiments of the present invention, definitions of the elements of the apparatus along with their different functions are given in the following:

Mobile Support Plates (4, 6)
- Definition: plates on which all the components of the plank guide mechanisms are fixed.
- Functions:
  - assuring the displacement of all the components of the plank guide mechanisms with the objective of maximizing the positioning of the plank; and
  - displacing the central axis (34) of the fine end of the plank, either toward the right or toward the left of a central axis (62) of the trimming heads (58). As the plank (2) is trimmed, the plank is displaced gradually so that the central axis (34) of the coarse end of the plank (2) corresponds to the central axis (64) of the apparatus or to the central axis (62) of the trimming heads (58) in order to maximize the quality and the yield of cutting the plank (2).

Shafts 66
- Function:
  - supporting and enabling the displacement of the support plates (4, 6).

Bushings 68
- Function:
  - guiding the displacement of the support plates (4, 6) on the shafts (66).

Jointed Arms (56)
- Functions:
  - linking the guide elements (14, 16) to the support plates (4, 6);
  - forming a parallelogram positioning system in order to assure that the displacement of the guide elements (14, 16) is always parallel to the central axis (64) of the apparatus and to the sides of the plank (2); and
  - exerting a lateral push on the plank (2) via the guide elements (14,16) for controlling the curve cutting.

Pivots (72)
- Function:
  - assuring the holding and the rotation of the arms (56) which form the parallelogram and which support the guide elements.

Hydraulic Actuators or Temposonic (54)
Functions:
displacing the mobile support plates (4, 6) on which all the components of the plank guide mechanisms are fixed with the objective of positioning the guide elements (14,16) in accordance with the width of the plank (2) to be guided;
reducing the displacement of the arms (56); reducing to a minimum the distance between the toothed wheels (50) of the corresponding support plates (4, 6) and the trimming heads (58) in order to maintain the plank as close as possible to the trimming heads (56) for eliminating the lateral displacement of the plank when the plank enters the trimming heads (58); and
positioning the plates (4, 6) as a function of the chosen cutting pattern (centered or not in relation to the central axis (64) of the apparatus; centered or not in relation to the cutting tools (22) and in accordance with the tapering of the plank).

Pivot Shafts (70)
Functions:
assuring the connection between the support plates (4, 6) and the hydraulic actuators or Temposonic (54); and
assuring the connection between the frame (8) and the hydraulic actuators or Temposonic (54).

Off-Center Dowels (74)
Function:
adjusting the actuators (54) parallel to the central axis (64) of the apparatus.

Pivot Shafts (76)
Function:
assuring the connection between the jointed arms (56) and the pneumatic actuators (78).

Pneumatic Actuators (76)
Functions:
providing the tightening pressure on the plank via the guide elements (14,16) for the curve cutting; and
opening the guide elements (14,16) for the curved cutting.

Pivot Shafts (80)
Function:
assuring the connection between the support plates (4, 6) and the pneumatic actuators (78).

Elements of the First Guide Mechanism (10, 12)
Definition: guide elements made of a plane surface whose length in contact with the surface of the plank is limited.
Functions:
assuring the guiding of the plank at the entrance of the guide elements (14, 16) for the curve cutting;
making the guide elements (14,16) open for the curve cutting;
limiting the curvature of the products cut from a plank whose curvature is too pronounced by effectuating a transfer of pressure on the second guide mechanism (14, 16). This transfer of pressure causes the second guide mechanism (14,16) to open. The central axis (34) of the plank is displaced in relation to the central axis of the second guide mechanism (14, 16). The plank is no longer trimmed following the natural curvature of the plank so that the curvature parameters for cut products which are set by the manufacturer can be achieved;
acting as a shock absorber for stabilizing the plank; and
reducing the vibrations caused by surface imperfections and knots on the sides of the plank.

Elements of the Second Guide Mechanism (14, 16)
Definition: guide mechanism made of a plane surface whose length in contact with the plank surface (2) is limited.
Functions:
assuring the guiding and trimming of the plank (2) following the natural curvature of the plank;
controlling the trimming that follows the curve of the plank (2);
positioning the plank (2) in a manner that is parallel in relation to the central axis (64) of the apparatus and centering the plank (2) in relation to pivot points (72) in order that the desired trimming pattern may be chosen;
maintaining the plank, regardless of the depth of the cut produced on the side of the plank by the trimming heads (58);
reducing the effect of the surface imperfections and the knots of the plank (2);
stabilizing the plank (2); and
driving the plank (2) into the cutting tools (22).

Toothed Wheels (60)
Function:
driving the belts (48).

Pivot Shafts (84)
Functions:
serving as a pivot point for the first guide mechanism (10, 12); and
guiding the toothed wheels (50).

Toothed Wheels (50)
Function:
guiding the belts (48) on the pivot axes (46) of the guide elements (10,12).

Toothed Chain Matted Belt (48)
Function:
driving the plank (2) in the guide mechanisms (10, 12) and (14, 16).

Toothed Chain Support Wall (52)
Function:
serving as a support plate for the belts (48).

Motorized Reduction Gear Group (82)
Function:
driving the belts (48) with the aid of the toothed wheels (60).

Mechanical Connection (86)
Definition: mechanical connection between the guide elements (14, 16) (automatic centering system).
Function:
ensuring the centering (opening or closing) of the guide elements (14, 16).

In order to be able to transversally displace the guide elements (14, 16) in opposite directions in relation to the path (20) and in a way that is parallel and centered in relation to the central axis (64) of the apparatus and in relation to the pivot points (72), so that the desired trimming pattern may be achieved.

Hydraulic Actuator or Temposonic (88)
Function:
adjusting the length of the mechanical connection (86) following the displacement of the plates (4, 6).

Fitting (90)

Definition: fitting on the mechanical connection (86).

Function:

adjusting the guide elements (14,16) so that they are at an equal distance from the pivot point (72) at all times and also from the central axis (64) of the apparatus.

Jointed Arms (92)

Function:

making the connection between the jointed arms (56) and the mechanical connection (96).

Pneumatic Actuators (96)

Functions:

opening and closing the first guide mechanism (10, 12);

exerting a tightening pressure on the plank in the first guide mechanism (10, 12) when the plank enters and is guided into the elements (14, 16);

controlling the curvature of the sawn products. The volume of air is constant in the pneumatic actuators (96) of the guide elements (10, 12) during the cutting cycle following the natural curvature of the plank. If a plank has a curvature that is too pronounced, the curvature has the effect of increasing the pressure on the side of the guide element on which it presses, either element 10 or 12. The second guide mechanism (14,16) reacts by opening in accordance with the pressure exerted by element 10 or 12;

exerting the guiding pressure on the plank in the first guide mechanism (10, 12) during the curve cutting, following the natural curvature of the plank with the guide elements (14,16); and absorbing the shocks and maintaining a pressure on a surface of the plank in order to eliminate the vibrations caused by the surface imperfections of the plank.

Pivot Shafts (94)

Functions:

making the link between the guide elements (14, 16) and the pneumatic actuators (96); and assuring the link between the guide elements (10, 12) and the pneumatic actuators (96).

Cutting and Shredding Heads (58)

Function:

cutting or squaring off the sides of the plank.

Guides (98) at the Exit of the Trimming Heads

Function:

guiding the plank.

Spindle of Saws (100)

Function:

sawing the plank.

Pressure Roll (30)

Function:

driving the plank to the exit.

The existing problems with curve cutting apparatuses described in the background section are corrected in the following ways, among others:

Creating vibrations on the plank: corrected by using the guide mechanisms that are based on surfaces which are in contact with the plank instead of one point for a roll.

Poor control of the position of the rolls: corrected by using a system of parallelogram arms (56) and an automatic centering mechanical connection (86) which assures that the displacement of the guide elements (14, 16) is parallel and automatically centered in relation to the central axis (64) of the apparatus and to the pivot axis (72).

Producing sawn timber with a deflection that is too large, when the natural curvature of a plank having a pronounced curvature is followed, resulting in the production of sawn timber that must be rejected: corrected by the guide elements at the entrance (10, 12) which use a transfer of pressure on the concave side of the plank towards the convex side. This permits the modification of the natural curve trajectory of the plank. The central axis (64) of the plank is modified in such a way that it is no longer parallel to the guide elements (14,16) when the curvature of the plank is too pronounced.

Having no option to reduce the effect of the tapering of the plank on the cutting yield: corrected with the possibility of displacing the plates (4, 6) which support the guide elements (14,16 and 10,12) during the cutting of the plank.

When a plank reaches the entrance of the guide mechanism, the rolls open and close on the plank, thus destabilizing the plank: corrected by the guide elements (10, 12) which close down on the plank and which have for a function to gradually open the guide elements (14, 16) and to maintain the plank in contact with the traction chain.

Referring to FIG. 1, and as previously mentioned, in order to determine a trimming pattern to be used for a given plank, the apparatus has evaluation means for evaluating the plank and for generating a signal (122) representing at least one parameter of the plank such as its tapering, thickness, length and curvature.

Preferably, this evaluation means is optimization software (120) which determines the choice of trimming pattern after an analysis of the form of the plank. The optimization software also determines the trimming pattern by way of laser cameras which take readings of the plank in order to reproduce the three-dimensional geometric form of said plank. The profile of the plank thus defined, the optimizer generates the optimal trimming solution as a function of at least one representative parameter. For example, the optimisation software of companies Autolog® and Optisim Consultants®, or all other optimisation software, can be used to this effect.

Preferably, the optimization software evaluates each plank as a function of certain characteristics and the cuttings to be produced according to the dimensions of the plank, the rules of quality and the value of the plank in order to choose the best trimming pattern based on the maximum value of the products and the volume of cut timber product.

Figures 15A, 15B, 15C:
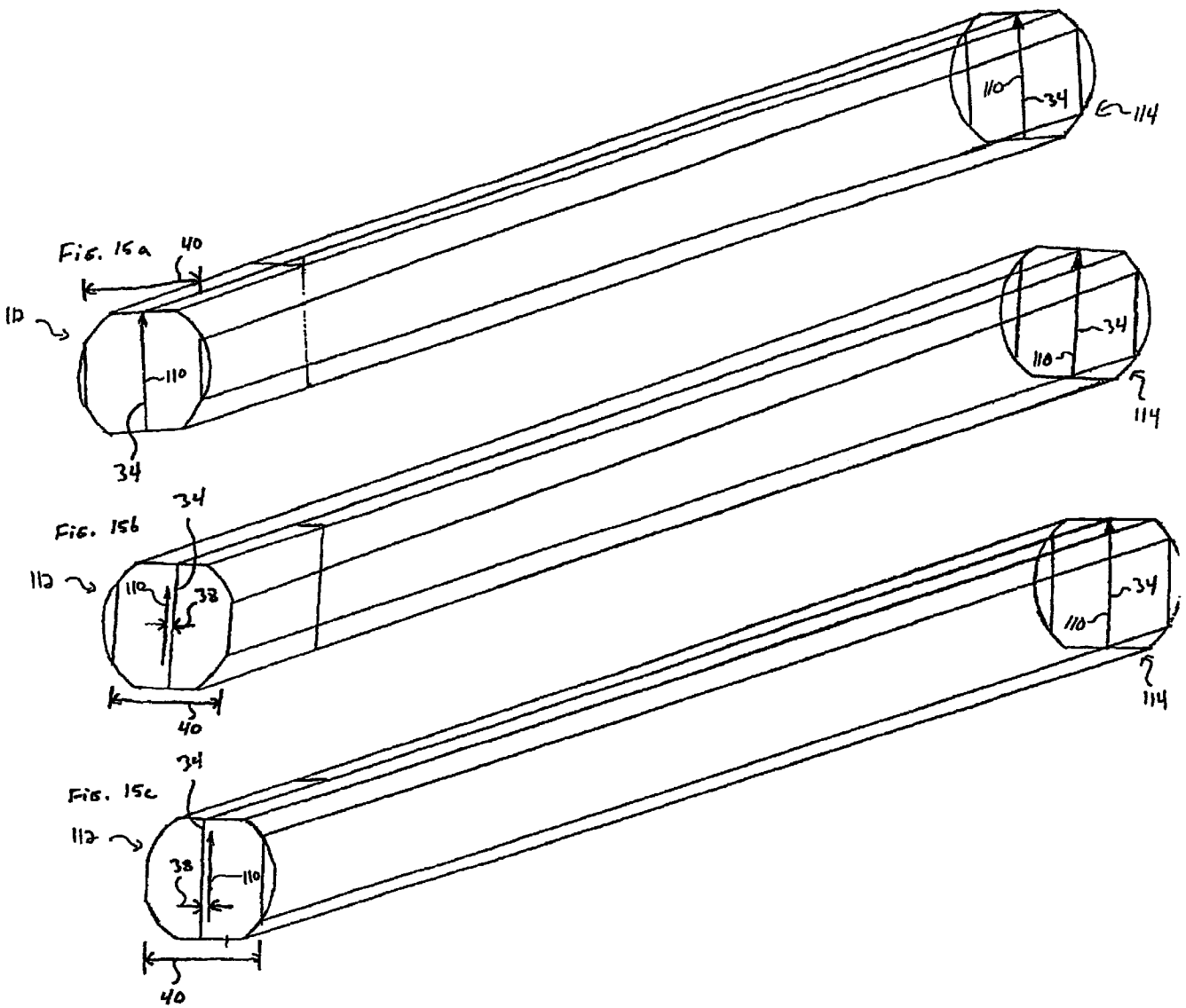
FIGS. 15*a*, 15*b* and 15*c* are perspective view schematics of planks having different cutting patterns.

FIG. 15*a* shows a cutting pattern (1 10) which is positioned centered on the central axis (34) of the plank (2) and the diameter (40) at the fine end of the resulting plank.

FIGS. 15*b* and 15*c* show a cutting pattern (1 10) that is off-center in relation to the central axis (34) of the plank (2) and the diameter (40) at the fine end (112) of the plank resulting from the displacement of the support plates (1, 6). The cutting pattern at the coarse end (1 14) of the plank is centered in relation to the central axis (34) of the plank.

Figure 16:
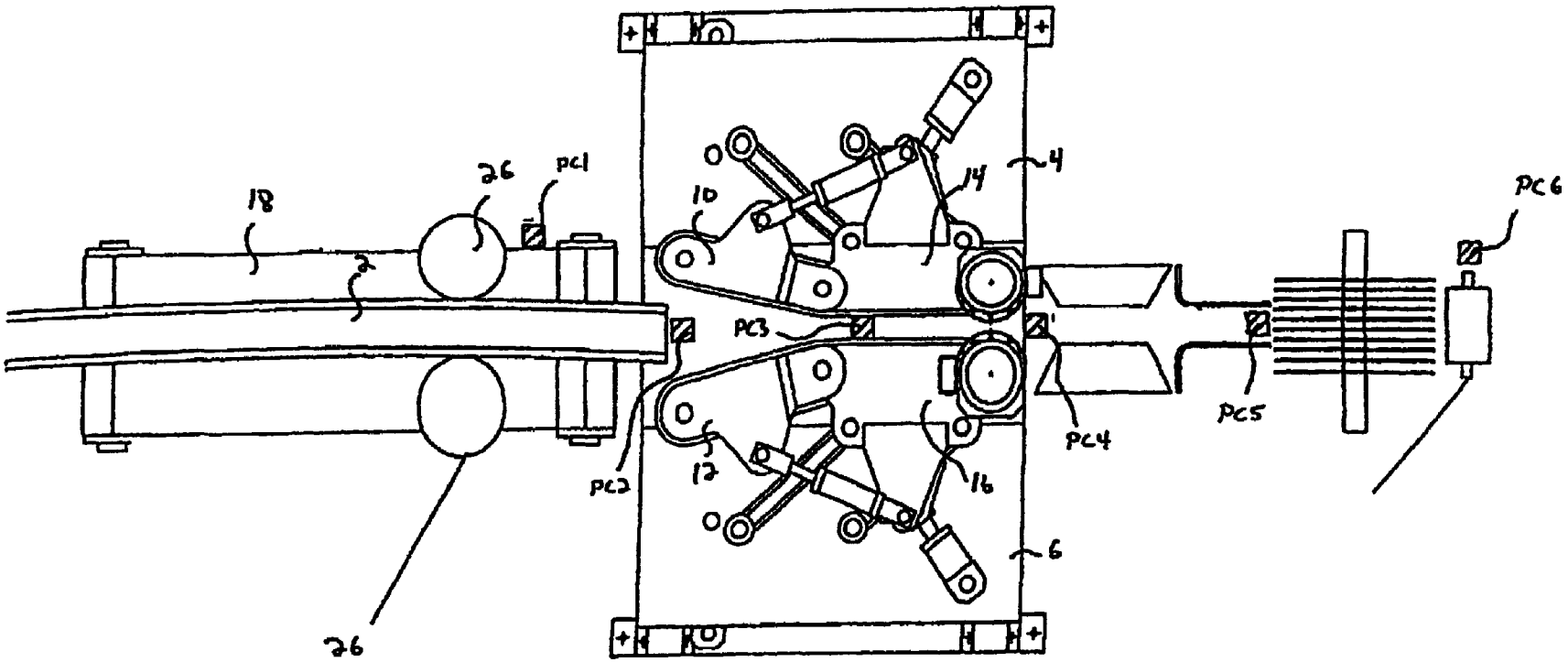
FIG. 16 is an above view schematic of a curve sawing apparatus according to the present invention, showing the location of the photocells.

Referring to FIG. 16, the apparatus preferably comprises detection means for detecting different positions of the plank in the apparatus, and activation means for activating the first and second guide and drive mechanisms as a function of different positions of the plank.

The detection means can comprise photocells for detecting a displacement of the plank when the plank is received by the first guide and drive mechanism.

Preliminary Control Sequence

The plank is detected by a photocell PC1:

on an entering conveyor (18), automatically centering rolls (26) close down on the plank so that the plank is in the axis of the first zone which assures the guiding of the plank at the entrance;

the plank can be stopped (stopping the conveyor (18)) if the opening of the guide mechanism (10,12) at the entrance of the first zone is not completed; and the plank can be stopped (stopping the conveyor (18) and stopping the automatically centering rolls (26)) if the plates (4, 6) and the mechanical connection (46) are not in their initial positions.

The plank is detected by a photocell PC2:

the pneumatic pressure is exerted on the guide elements (10, 12) and immediately closes down on the plank. The pneumatic pressure is blocked until the guide elements (10, 12) are opened;

the automatically centering rolls (26) are repositioned at the initial position waiting the next plank; and the plank is stopped (stopping the motors (82) of the traction chains, stopping the motor of the entrance conveyor and stopping the motors of the automatically centering rolls) if the adequate positioning of the trimming heads (58) and the saws (100) has not been completed, all this as a function of the profile of the plank and of the cutting pattern chosen.

The end of the plank is detected by a photocell PC2:

the guide elements (10, 12) open to their initial position.

The plank is detected by a photocell PC3:

the pressure is put on the actuators of the guide elements (14,16); and the pressure is blocked by the pneumatic system of actuators of the guide elements at the entrance (10,12) in order to limit the curve cutting of a plank whose deflection is too large.

The end of the plank is detected by a photocell PC4:

the guide elements (14, 16) are immediately replaced to their initial positions and the pressure is also released.

The plank is detected by a photocell PC5:

the pressure rolls (30) located after the saws are lowered after a certain delay to adapt to the height of the plank to be sawn.

The end of the plank is detected by a photocell PC5:

the trimming heads (58) take on their initial position.

The end of the plank is detected by a photocell PC6:

the pressure rolls (30) located after the saws take on their initial position; and the saws (100) take on their initial position.

The present invention further concerns a method for guiding a plank toward cutting tools, comprising the following steps:

a) evaluating the plank (2) and generating a signal (122) representing at least one parameter of the plank (2);

b) receiving, guiding and driving the plank (2) along the path (20) by the first guide and drive mechanism, the first mechanism comprising the two first guide and drive elements (10, 12) and arranged opposite in relation to the path;

c) guiding and driving the plank by the second guide and drive mechanism from the first mechanism along the path up to the cutting tools (22), the second mechanism comprising the two second guide and drive elements arranged opposite in relation to the path and being substantially parallel to the path, the guide and drive elements of the mechanisms located on the same side of the path being connected by a pivot axis; and d) displacing the guide and drive elements of the first and second mechanisms in a way that is parallel and equidistant in relation to the path and in response to the signal.

The invention is not limited to the preferred embodiment described and represented in the drawings. Accordingly, various modifications may be made, in particular with regards to the composition of the diverse elements or through substitution of equivalent techniques, without departing from the spirit or scope of the general inventive concept under protection.

What is claimed is:

1. An apparatus for guiding and driving a plank along a given path towards cutting tools for curve sawing the plank based on at least one parameter of the plank, the apparatus comprising:

evaluation means for evaluating the plank and generating a signal representing the at least one parameter of the plank;

a frame;

a platform mounted on the frame and having a support surface for supporting the plank, the path along which the plank is to be guided and driven being defined on the support surface of the platform, said platform further comprising at least one support plate displaceable transversally in relation to the path, in response to the signal, via at least one actuator;

a first guide and drive mechanism mounted on the platform for receiving, guiding and driving the plank along the path on the support surface, the first mechanism comprising two first guide and drive elements arranged on opposite sides of the path and being displaceable at an angle with respect to the path;

a second guide and drive mechanism mounted on the platform for guiding and driving the plank from the first mechanism along the path on the support surface up to the cutting tools, the second mechanism comprising two second guide and drive elements arranged on opposite sides of the path and being substantially parallel to the path; and displacing means for displacing the guide and drive elements from second mechanisms in parallel and equidistant in relation to the path, in response to the signal, and for displacing the guide and drive elements from the first mechanism independently and at an angle with respect to the guide and drive elements from the second mechanism;

wherein the guide and drive elements of the mechanisms located on a same side of the path are connected by a pivot axis, and are provided with an endless belt having an exterior contact surface for cooperating with the plank to be guided;

wherein at least one of the guide and drive elements of the second mechanism is mounted onto the at least one support plate so as to be displaceable transversally in relation to the path; and wherein the first and second mechanisms each comprise means for independently exerting a pressure onto their respective guide and drive elements on each side of the plank in response to the signal.

2. The apparatus according to claim 1, wherein each of the guide and drive elements of the mechanisms comprises toothed wheels for driving the endless belt, and wherein the exterior surface of the endless belt is covered with a toothed chain mat.

3. The apparatus according to claim 2, wherein the guide and drive elements of the mechanisms located on the same side of the path have a common toothed wheel which is able to turn about the pivot axis, the belts of the guide and drive elements of the mechanism located on the same side of the path together forming a single belt.

4. The apparatus according to claim 2, wherein each of the guide and drive elements of the mechanisms comprises a support wall facing the path and located between the intended wheels for supporting the belt.

5. The apparatus according to claim 1, wherein the displacing means comprises:

first and second pairs of jointed arms located on either side of the path, the arms of each pair being arranged in parallel, the arms of each pair being mounted between the support surface and the corresponding second guide and drive element; and a mechanical connection linking the first and second pairs of jointed arms for coordinating a movement of the pairs of jointed arms in parallel and equidistant relative to the path.

6. The apparatus according to claim 5, wherein the mechanical connection comprises means for adjusting the length of the mechanical connection according to the distance between the support plates.

7. The apparatus according to claim 6, wherein the means for adjusting the length of the mechanical connection comprise an actuator mounted on the mechanical connection between the first and second pairs of jointed arms.

8. The apparatus according to claim 1, wherein the means for exerting a pressure on the first guide and drive elements comprise two actuators being mounted between the first guide and drive element and the second guide and drive element of a same side of the path.

9. The apparatus according to claim 1, wherein the means for exerting a pressure on the second guide and drive elements comprise two actuators being mounted between the support surface and the corresponding second guide and drive element.

10. The apparatus according to claim 1, wherein the means for exerting a pressure on the first guide and drive elements comprise two bellows being mounted between the first guide and drive element and the second guide and drive element of a same side of the path.

11. The apparatus according to claim 1, wherein the means for exerting a pressure on the second guide and drive elements comprise two bellows being mounted between the support surface and the corresponding second guide and drive element.

12. The apparatus according to claim 1, further comprising two trimming heads mounted on either side of the path.

13. The apparatus according to claim 1, further comprising detection means for detecting different positions of the plank in the apparatus, and activation means for activating the first and second guide and drive mechanisms as a function of the different positions of the plank.

14. The apparatus according to claim 13, wherein the detection means comprise photo cells for detecting a displacement of the plank when said plank is received by the first guide and drive mechanism.

* * * * *